US005223215A

United States Patent [19]

Charbonnier et al.

[11] Patent Number: 5,223,215

[45] Date of Patent: Jun. 29, 1993

[54] METHOD OF IMPROVING THE PERFORMANCE OF MAGNESIUM ALLOYS IN RESPECT OF MICROSHRINKAGE

[75] Inventors: Jean Charbonnier, Rive-sur-Fure; Gilles Nussbaum, Marlioz; Gilles Regazzoni, Grenoble, all of France

[73] Assignee: Pechiney Electrometallurgie, Courbevoie, France

[21] Appl. No.: 760,474

[22] Filed: Sep. 16, 1991

[30] Foreign Application Priority Data

Sep. 28, 1990 [FR] France ..... 90 12455

[51] Int. Cl.[5] ..... C22C 23/00

[52] U.S. Cl. ..... 420/407; 148/420; 420/402

[58] Field of Search ..... 420/402, 405, 407; 148/420

[56] References Cited

U.S. PATENT DOCUMENTS 1,979,452 11/1934 Cooper ..... 420/402
2,221,254 11/1940 Hanawalt et al. ..... 75/168
2,464,918 3/1949 Ball et al. ..... 75/168
3,119,684 1/1964 Foerster ..... 420/407
5,143,564 9/1992 Gruzelski et al. ..... 148/420

FOREIGN PATENT DOCUMENTS 1214787 4/1960 France .

OTHER PUBLICATIONS

Binary Alloy Phase Diagrams (eds) Massalski, ASM, 1986, pp. 1549–1550.

*Primary Examiner*—Upendra Roy
*Attorney, Agent, or Firm*—Dennison, Meserole, Pollack & Scheiner

[57] ABSTRACT

A process for forming cast, magnesium based alloy articles having reduced microshrinkage comprising the steps of forming a molten alloy consisting essentially of magnesium together with 4 to 10% by weight aluminum, 0 to 1% by weight manganese, and either 0 to 3% by weight zinc or 0 to 1% by weight silicon, adding to the molten alloy 0.01 to 2% by weight strontium, and molding the molten alloy and solidifying to form a cast alloy article.

8 Claims, 1 Drawing Sheet

METHOD OF IMPROVING THE PERFORMANCE OF MAGNESIUM ALLOYS IN RESPECT OF MICROSHRINKAGE

BACKGROUND OF THE INVENTION

The invention relates to a method of improving the performance of magnesium alloys in respect of microshrinkage.

Magnesium alloys are here understood as being all those which contain from 4 to 10% by weight of aluminium and either up to 3% of zinc and/or up to 1% of manganese or up to 1% of silicon and/or up to 1% of manganese, the balance being magnesium.

Alloys which the ASTM standards define as follows may be mentioned more particularly:

AZ63 (alloy containing 6.0% by weight of aluminium, 3.0% of zinc, at least 0.15% of magnanese)

AZ80 (alloy containing 8.5% by weight of aluminium, 0.5% of zinc, at least 0.12% of manganese)

AZ91 (alloy containing 8.7% by weight of aluminium, 0.7% of zinc, at least 0.13% of manganese)

AZ92 (alloy containing 9.0% by weight of aluminium, 2.0% of zinc, at least 0.1% of manganese)

AM60 (alloy containing 6.0% by weight of aluminium, 0.13% of manganese)

AM100 (alloy containing 10.0% by weight of aluminium, 0.1% of manganese)

AS41 (alloy containing 4.2% by weight of aluminium, 0.35% of manganese).

These alloys have good mechanical properties and excellent corrosion resistance. However when they are moulded by gravity from liquid metal, either in a sand mould, in a sealed mould or by moulding under pressure, they generally have microshrinkages in their structure. These are due to the fact that the metal contracts during solidification, possibly to the extent of several % by volume. If no liquid metal is added in the contraction zone a void is then produced, resulting in the formation of a cavity or shrinkage.

When the solidification interval of the metal is very long, as in the case of the above-mentioned alloys, a relatively extensive pasty zone forms in the moulded piece, in which contraction takes place gradually. The liquid metal thus has to make its way between the solid dendrites over a great distance and cannot fill the voids. Microcavities are consequently formed, distributed between the grains throughout the pasty zone; these are described as microshrinkages.

Now microshrinkages tend to degrade the mechanical properties of the pieces which contain them. Furthermore, in the case of thin-walled pieces, they form open pores which make them useless for applications where they are subjected to pressure.

When one wishes to obtain moulded pieces from these alloys, which have good mechanical properties or at least are sealed, the problem thus arises of preventing the formation of the microshrinkages without thereby harming other properties such as corrosion resistance.

The problem is not of course new, and persons skilled in the art of magnesium alloy foundry have been led to seek solutions which would resolve it.

The addition of calcium has been found, for example, to reduce the presence of microporosity in the magnesium alloys listed above. British patent no. 847.992 may be quoted in this field. This states on page 2, lines 95–99, that magnesium alloys with a high aluminium and zinc content tend to form microshrinkages and that the presence of calcium greatly reduces the tendency. It may be noted however that according to claim 1 the quantities used are from 0.5 to 3%. These are relatively large quantities and create some difficulties in manufacture, particularly adhesion of the metal and/or pieces to the equipment.

SUMMARY OF THE INVENTION

Applicants have therefore tried to find a different solution with less disadvantages. This has led them to develop a method of improving the performance of magnesium alloys in respect of microshrinkage during moulding, the alloys containing 4 to 10% by weight of aluminium and either up to 3% of zinc and/or up to 1% of manganese, or up to 1% of silicon and/or up to 1% of manganese as the chief added elements, characterised in that strontium is added to said alloys before moulding.

The invention thus comprises adding an element of the alkaline earth metal family, viz strontium, to the magnesium alloy.

The presence of strontium in magnesium alloys has admittedly been reported elsewhere; British patents 687.934, 687.935 and 1.354.363 may be quoted in this connection. But these documents concern alloys containing lithium and zirconium and/or cadmium and silver. As for strontium, it appears among other alloying elements such as zinc, cadmium, thorium, mercury, silver, barium, calcium and lead, and no particular function is attributed to it. Applicants have found that the addition of strontium to the above mentioned magnesium alloys has the following effects:

concentrating microshrinkage in a relatively restricted zone of the piece, and in any case in a zone close to the mouth of the mould, that is to say, the part in the vicinity of the feed, thus enabling a sound piece to be obtained by risering that zone;

very substantially reducing the difference between the minimum density and the density of the alloy where the strontium contents are highest;

thereby improving the mechanical properties of the pieces obtained without harming their corrosion resistance.

The quantity of strontium added is preferably from 0.01 to 2% by weight of the alloy. Below 0.01% the effect is negligible, and above 2% the addition is found to be harmful, since a large quantity of intermetallic compounds form and embrittle the metal.

The addition is preferably made in elemental form by the methods known in the art.

DESCRIPTION OF THE PREFERRED EMBODIMENTS

EXAMPLE 1

Figure 1:
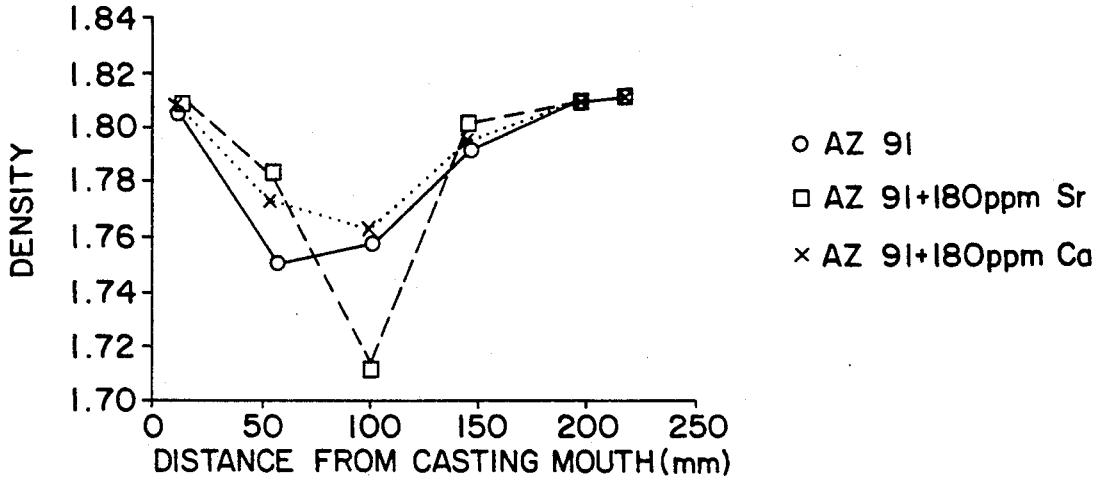
FIG. 1 is graph of density versus distance from the casting mouth for AZ91 alloy, AZ91 containing 180 ppm strontium and AZ91 containing 180 ppm calcium.
Figure 2:
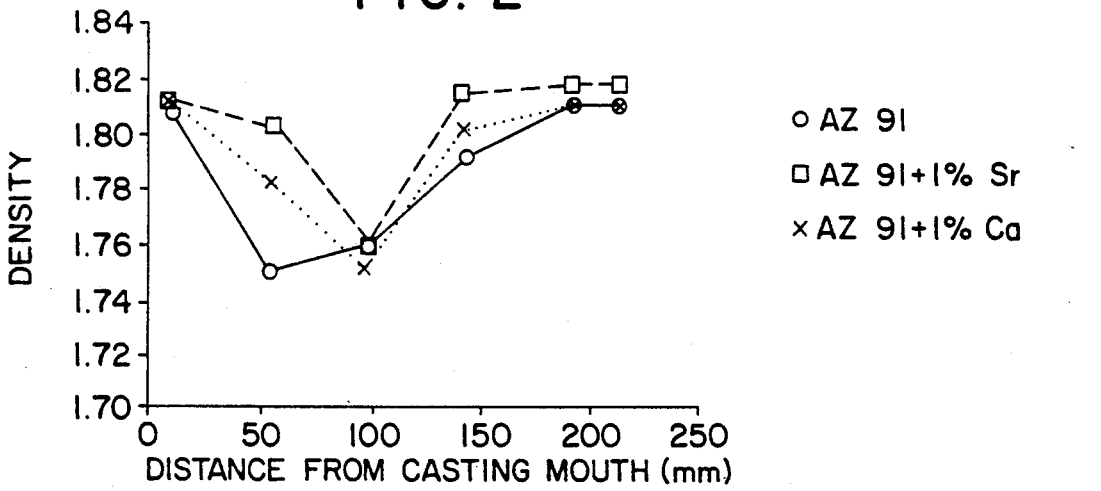
FIG. 2 is a graph of density versus distance from the casting mouth for AZ91 alloy, AZ91 containing 1% strontium and AZ91 containing 1% calcium.
Figure 3:
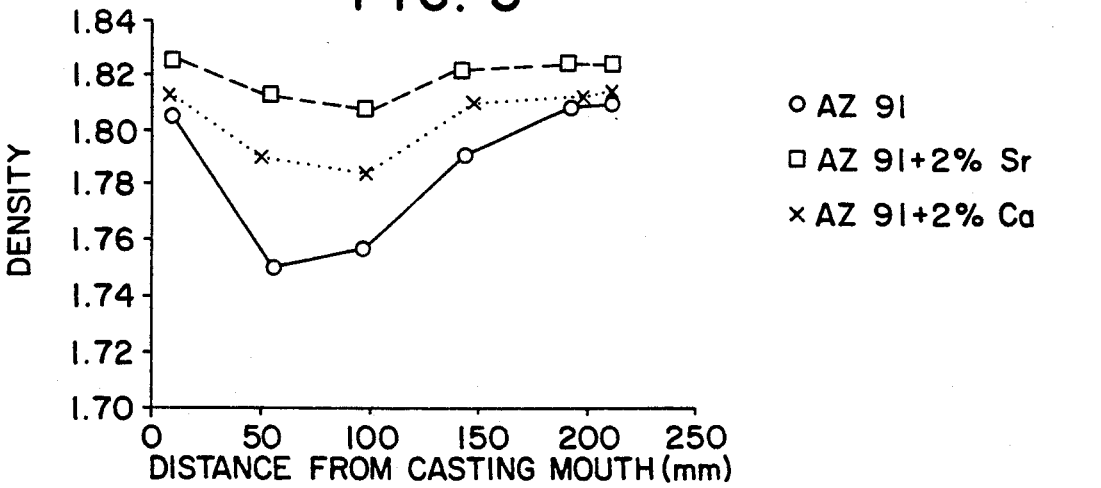
FIG. 3 is a graph of density versus distance from the casting mouth for AZ91 alloy, AZ91 containing 2% strontium and AZ91 containing 2% calcium.

The purpose is to show the respective effect of the additions of strontium and calcium on the density of the pieces. Parallelipipedal specimens (15×30×250 mm3) are cast under similar conditions in sand moulds at a temperature of 700° C. When they have been demoulded they are X rayed, the density is measured and the evolution of the density of the alloy is studied as a function of the distance from the casting mouth.

AZ91 alloys containing (a) 0; 0.018; 1 and 2% of strontium and (b) 0.018; 1 and 2% of calcium are subjected to this method. The results are given in diagrams 1, 2 and 3, which compare the effect of both calcium and strontium for each of these contents.

In specimens containing strontium it is found that:

- the density at a distance of 150 mm from the mouth is virtually equal to the theoretical density of the alloy;
- the higher the strontium content, the more the number of micropores is reduced;
- faults are concentrated in a small zone, whereas the rest of the specimen is more sound than AZ91. In the case of an industrial installation the fault zone would be fed with a riser.

As far as calcium is concerned, it also has an effect though a considerably less broad one than strontium.

EXAMPLE 2

The purpose of this example is to show the effect of strontium on the mechanical properties of alloy AZ91. Specimens without microshrinkages, in states T4 and T6 and containing 0 and 0.3% of strontium, are subjected to tension tests at ambient temperature, and the values of the elastic limit R0.2, rupture strength Rm and elongation A are measured. The results are given in the following table.

It will be recalled that states T4 and T6 correspond to dissolving heat treatments, following by a natural ageing treatment in the first case and an artificial one in the second.

| ALLOY | RP 0.2 (Mpa) | Rm (Mpa) | A % |
|---|---|---|---|
| AZ91 T4 | 79.3 ± 3.8 | 205.7 ± 16.0 | 6.74 ± 2.26 |
| AZ91 + 0.3% Sr T4 | 87.3 ± 8.0 | 202.3 ± 38.0 | 5.09 ± 2.74 |
| AZ91 T6 | 127.3 ± 3.8 | 208.3 ± 8.7 | 1.63 ± 0.30 |
| AZ91 + 0.3% Sr T6 | 124.0 ± 6.6 | 197.0 ± 47.2 | 1.49 ± 1.48 |

It is found that the addition of strontium does not adversely affect mechanical tensile properties and even improves the elastic limit of the alloy in state T4. Moreover, since the presence of strontium guarantees that there will be no microshrinkages, one can be sure that the values obtained are representative of the properties of the whole piece, a result which is more difficult to obtain in the absence of strontium.

EXAMPLE 3

The purpose of this example is to show the effect of strontium on corrosion resistance.

For this purpose specimens of AZ91 containing 0, 0.018 and 0.3% of strontium, taken from the centre of the moulded specimens and given T4 or T6 treatment, are subjected to the action of an aqueous solution containing 5% by weight of sodium chloride for 3 days, then the weight loss of the specimen is measured.

The results are given in the following table:

| ALLOY | LOSS ($mg/cm^2/day$) |
|---|---|
| AZ91 T4 | 9.99 ± 0.25 |
| AZ91 180 ppm Sr T4 | 6.03 ± 1.16 |
| AZ91 0.3% Sr T4 | 4.60 ± 0.95 |
| AZ91 T6 | 2.68 ± 0.57 |
| AZ91 180 ppm Sr T6 | 2.63 ± 0.45 |
| AZ91 0.3% Sr T6 | 1.22 ± 0.10 |

These results show that the addition of strontium leads to a considerable reduction in the weight loss of the specimen, particularly for contents of 0.3%.

Thus the absence of microshrinkages substantially reduces the specific surface area of the specimens and consequently improves corrosion resistance.

The invention can be applied particularly to the manufacture of gearbox cases and structural components of portable computers.

What is claimed is:

1. A process for forming cast, magnesium-based alloy articles having reduced microshrinkage, comprising the steps of:

forming a molten alloy consisting essentially of magnesium together with 4 to 10% by weight aluminum, 0–1% by weight manganese and either 0–3% by weight zinc or 0–1% by weight silicon;

adding to said molten alloy 0.01 to 2% by weight strontium; and molding said molten alloy and solidifying to form said cast alloy article.

2. The process of claim 1, wherein the strontium is added in elemental form.

3. The process of claim 1, wherein the strontium is added in an amount of at least 0.018% by weight.

4. The method of claim 1, wherein said molding takes place in a sand mold.

5. The process of claim 1, wherein said molten alloy consists essentially of magnesium together with about 8.7% by weight aluminum, 0.7% by weight zinc and at least 0.13% by weight manganese.

6. The method of claim 1, wherein said molding takes place at a temperature of about 700° C.

7. The process of claim 1, wherein said alloy contains at least about 0.1% by weight Mn.

8. In a process for forming cast, magnesium-based alloy articles comprising the steps of:

forming a molten alloy consisting essentially of magnesium together with 4 to 10% by weight aluminum, 0–1% by weight manganese and either 0–3% by weight zinc or 0–1% by weight silicon; and molding said molten alloy and solidifying to form said cast alloy article, the improvement comprising adding to said molten alloy 0.01 to 2% by weight strontium, to reduce the microshrinkage resulting from the molding.

* * * * *